US010734149B2

(12) United States Patent
Powell et al.

(10) Patent No.: US 10,734,149 B2
(45) Date of Patent: Aug. 4, 2020

(54) ELECTRO-PERMANENT MAGNETIC DEVICES INCLUDING UNBALANCED SWITCHING AND PERMANENT MAGNETS AND RELATED METHODS AND CONTROLLERS

(71) Applicant: WEN Technology, Inc., Morrisville, NC (US)

(72) Inventors: John William Powell, Raleigh, NC (US); Christopher J. Brusa, Raleigh, NC (US); William A. Henley, Washington, NC (US)

(73) Assignee: WEN TECHNOLOGY INC., Morrisville, NC (US)

( * ) Notice: Subject to any disclaimer, the term of this patent is extended or adjusted under 35 U.S.C. 154(b) by 564 days.

(21) Appl. No.: 15/466,174

(22) Filed: Mar. 22, 2017

(65) Prior Publication Data

US 2017/0278613 A1 Sep. 28, 2017

Related U.S. Application Data

(60) Provisional application No. 62/312,259, filed on Mar. 23, 2016.

(51) Int. Cl.

| | |
|---|---|
| ***H01F 7/20*** | (2006.01) |
| ***H01F 1/053*** | (2006.01) |
| ***H01F 7/06*** | (2006.01) |

(52) U.S. Cl.

CPC ..... *H01F 7/206* (2013.01); *H01F 7/064* (2013.01); *H01F 2007/208* (2013.01)

(58) Field of Classification Search

CPC .... H01F 2007/208; H01F 7/064; H01F 7/206; H01F 1/053; H01F 1/147

See application file for complete search history.

(56) References Cited

U.S. PATENT DOCUMENTS

| | | | | |
|---|---|---|---|---|
| 4,507,635 | A | 3/1985 | Cardone et al. | |
| 4,847,582 | A | 7/1989 | Cardone et al. | |
| 4,956,625 | A * | 9/1990 | Cardone ..... | B23Q 3/1546 335/290 |
| 5,822,243 | A | 10/1998 | Shone | |

(Continued)

FOREIGN PATENT DOCUMENTS

| | | |
|---|---|---|
| JP | 62094257 | 4/1987 |
| JP | 8-155831 | 6/1996 |

*Primary Examiner* — Bernard Rojas
(74) *Attorney, Agent, or Firm* — Sage Patent Group

(57) ABSTRACT

A method of operating an electro-permanent magnet may include switching the electro-permanent magnet from an on state wherein magnetic fields of switching and permanent magnets combine to generate a first magnetic field having a first magnitude and a first polarity to a reversed state having a second polarity wherein magnetic fields of the switching magnets and the permanent magnets combine to generate a second magnetic field having a second magnitude less than the first magnitude and a second polarity different than the first polarity. The electro-permanent magnet may be switched from the reversed state to an off state wherein magnetic fields of the switching and permanent magnets combine to generate a third magnetic field having a magnitude that is no more than 50 percent of the second magnitude. Related electro-permanent magnets are also discussed.

23 Claims, 6 Drawing Sheets

(56) References Cited

U.S. PATENT DOCUMENTS

| | | | | |
|---|---|---|---|---|
| 5,888,120 | A | 3/1999 | Doran | |
| 5,989,103 | A | 11/1999 | Birang et al. | |
| 6,050,882 | A | 4/2000 | Chen | |
| 6,183,342 | B1 | 2/2001 | Watanabe et al. | |
| 6,213,855 | B1 | 4/2001 | Natalicio | |
| 6,292,078 | B1 | 9/2001 | Cardone et al. | |
| 6,325,696 | B1 | 12/2001 | Boggs et al. | |
| 6,354,928 | B1 | 3/2002 | Crevasse et al. | |
| 6,436,828 | B1 | 8/2002 | Chen et al. | |
| 6,489,871 | B1 * | 12/2002 | Barton | B25B 11/002 335/285 |
| 6,592,434 | B1 | 7/2003 | Vanell et al. | |
| 6,719,615 | B1 | 4/2004 | Molnar | |
| 6,899,607 | B2 | 5/2005 | Brown | |
| 7,066,785 | B2 | 6/2006 | Park et al. | |
| 7,999,645 | B2 | 8/2011 | Sarda | |
| 2003/0174457 | A1 | 9/2003 | Herbst | |
| 2014/0049347 | A1 * | 2/2014 | Barton | B25B 11/002 335/290 |
| 2014/0285930 | A1 | 9/2014 | Powell | |

* cited by examiner

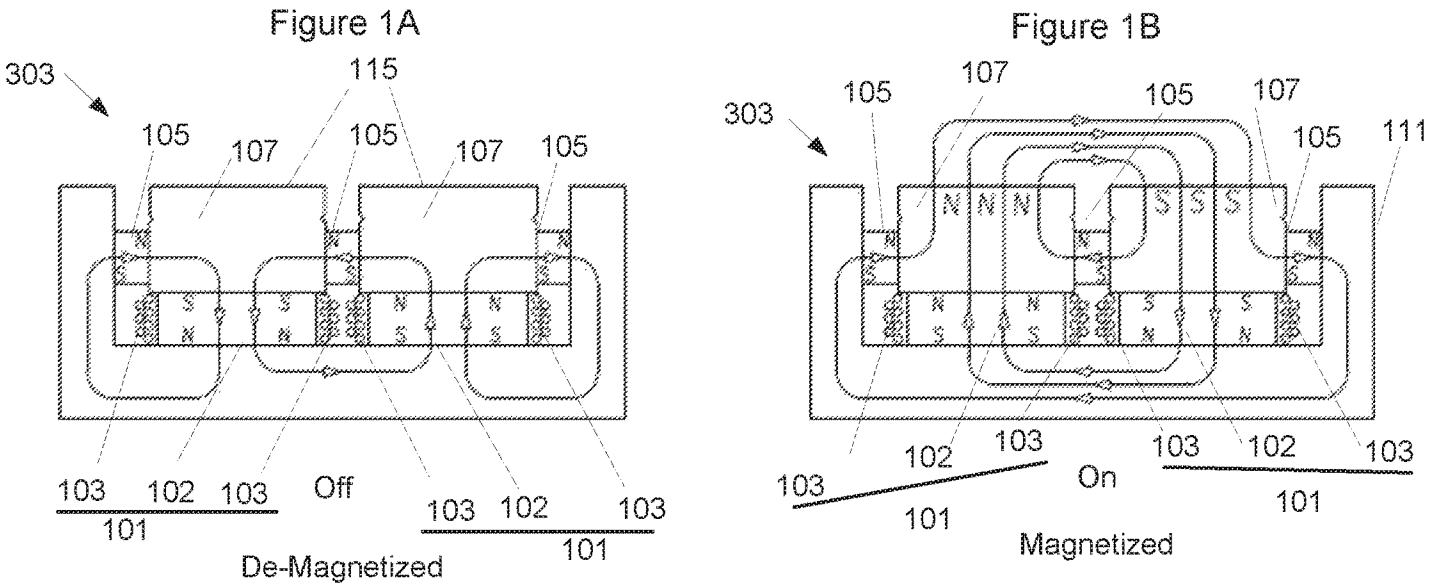
Figure 1A
303
105
107
115
105
107
105
101
102
103
103
102
103
Off
De-Magnetized
Figure 1B
303
105
107
105
107
111
101
102
103
103
102
103
101
On
Magnetized
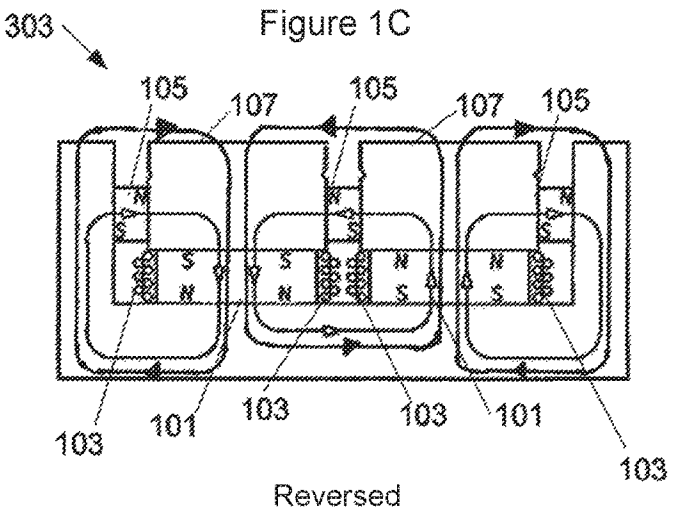
Figure 1C
303
105
107
105
107
105
101
103
103
101
103
103
Reversed

ELECTRO-PERMANENT MAGNETIC DEVICES INCLUDING UNBALANCED SWITCHING AND PERMANENT MAGNETS AND RELATED METHODS AND CONTROLLERS

RELATED APPLICATION

The present application claims the benefit of priority from U.S. Provisional Application No. 62/312,259, filed Mar. 23, 2016, the disclosure of which is hereby incorporated herein in its entirety by reference.

TECHNICAL FIELD

The present disclosure is directed to magnetic devices, and more particular to electro-permanent magnetic devices and related methods.

BACKGROUND

Electro-permanent magnetic devices are used in industrial systems, for example, to magnetically clamp objects securely without fear of loss of magnetic clamping force due to power failures. Applications include holding workpieces during machining, holding dies/molds in presses, lifting, transporting, etc.

The magnetic circuit of an electro-permanent magnetic device includes an electro-permanent magnet that can be electrically switched between On (magnetized) and Off (de-magnetized) states, and once in either state, no further electrical energy is required to maintain the electro-permanent magnet in that state. Once energized, the electro-permanent magnet can thus be disconnected from electrical power indefinitely without losing magnetic clamping power.

The ability to disconnect an electro-permanent magnetic device from power without losing magnetic clamping power is valuable because it allows a part to be loaded on an electro-permanent magnetic chuck, and then the chuck can be disconnected from power and moved through multiple processing stations without the need of an electrical connection being maintained with the chuck and without fear of losing holding power.

In a double magnet DM device, permanent magnets and switching magnets are used together so that the switching magnets can be programmed in a first polarity to turn the DM device on (so that magnetic energy of the permanent and switching magnets combine) and so that the switching magnets can be programmed in a second polarity to turn the DM device off (so that magnetic energy of the permanent and switching magnets cancel). In the on state, the combined magnetic energies of the permanent and switching magnets flow out of the device to hold a workpiece. In the off state, magnetic energy of the permanent and switching magnets are trapped in the device so that the workpiece may be released.

When the DM device is turned off, however, the workpiece may remain partly magnetized, and the residual magnetism in the workpiece may create a weak magnetic circuit, making the workpiece difficult to remove from the DM device even though the magnetism has been turned off.

SUMMARY

According to some embodiments of inventive concepts, a method may be provided to operate an electro-permanent magnet including a plurality of permanent magnets, a plurality of switching magnets, and a working surface. The method may include switching the electro-permanent magnet from an on state wherein magnetic fields of the switching and permanent magnets combine to generate a first magnetic field having a first magnitude and a first polarity extending beyond the working surface to a reversed state having a second polarity wherein magnetic fields of the switching magnet and the permanent magnet combine to generate a second magnetic field having a second magnitude and a second polarity extending beyond the working surface, with the second magnitude being less than the first magnitude, and with the first and second polarities being different. The electro-permanent magnet may be switched from the reversed state to an off state wherein magnetic fields of the switching and permanent magnets combine to generate a third magnetic field having a magnitude beyond the working surface that is no more than 50 percent of the second magnitude beyond the working surface.

According to some other embodiments of inventive concepts, an electro-permanent magnet may include a plurality of pole pieces, a plurality of permanent magnets, and a plurality of switching magnets. Each of the plurality of permanent magnets may be arranged adjacent at least one of the plurality of pole pieces. Each of the plurality of switching magnets may be adjacent at least one of the plurality of pole pieces. Each of the plurality of switching magnets may include a soft magnetic material and an electrically conductive coil so that a polarity and a magnitude of a magnetic field generated by the soft magnetic material is programmable responsive to electrical energy applied to the electrically conductive coil. Moreover, the plurality of switching magnets may be unbalanced relative to the plurality of permanent magnets.

According to still other embodiments of inventive concepts, a controller may be provided for an electro-permanent magnet including a plurality of permanent magnets, a plurality of switching magnets, and a working surface. The controller may include a power switching device (between an input coupling for an electrical power source and an output coupling for the electro-permanent magnet) and a processor coupled to the power switching device. The processor may be configured to control the power switching device to switch the electro-permanent magnet from an on state wherein magnetic fields of the switching and permanent magnets combine to generate a first magnetic field having a first magnitude and a first polarity extending beyond the working surface to a reversed state having a second polarity wherein magnetic fields of the switching magnet and the permanent magnet combine to generate a second magnetic field having a second magnitude and a second polarity extending beyond the working surface wherein the second magnitude is less than the first magnitude and wherein the first and second polarities are different. The controller may be further configured to switch the electro-permanent magnet from the reversed state to an off state wherein magnetic fields of the switching and permanent magnets combine to generate a third magnetic field having a magnitude beyond the working surface that is no more than 50 percent of the second magnitude beyond the working surface.

BRIEF DESCRIPTION OF THE DRAWINGS

The accompanying drawings, which are included to provide a further understanding of the disclosure and are incorporated in and constitute a part of this application, illustrate certain non-limiting embodiments of inventive concepts. In the drawings:

FIGS. 1A, 1B, and 1C are cross sectional views illustrating a double magnet circuit in de-magnetized (off), magnetized (on), and reversed states respectively according to some embodiments of inventive concepts;

DETAILED DESCRIPTION

Figure 2A:
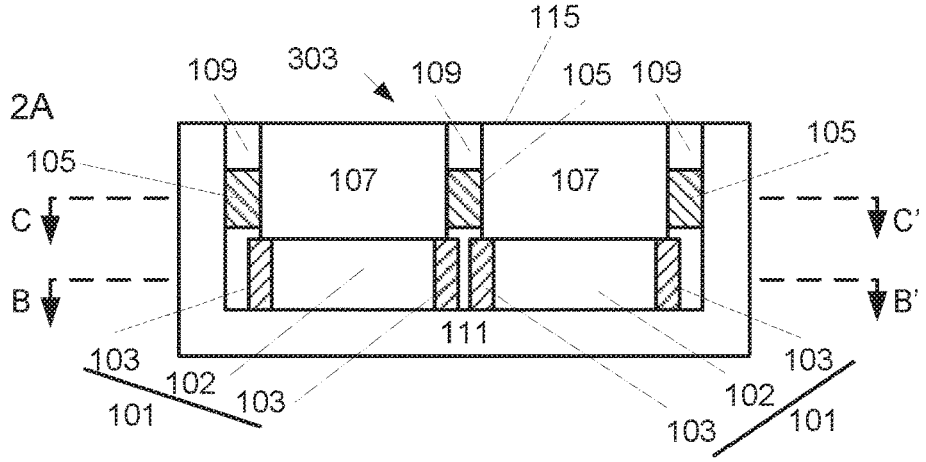
FIG. 2A is a cross sectional view illustrating a double magnet circuit according to some embodiments of inventive concepts.

Inventive concepts will now be described more fully hereinafter with reference to the accompanying drawings, in which examples of embodiments of inventive concepts are shown. Inventive concepts may, however, be embodied in many different forms and should not be construed as limited to the embodiments set forth herein. Rather, these embodiments are provided so that this disclosure will be thorough and complete, and will fully convey the scope of inventive concepts to those skilled in the art. It should also be noted that these embodiments are not mutually exclusive. Components from one embodiment may be tacitly assumed to be present/used in another embodiment.

FIGS. 1A, 1B, and 1C illustrate an example of a circuit of an electro-permanent magnetic device according to some embodiments of inventive concepts. The DM (double magnet) circuit of FIGS. 1A, 1B, and 1C uses two types of magnets, a switching magnet 101 (also referred to as a programmable magnet) including a switching magnetic material (having relatively low coercivity) 102 and a coil 103 (used to switch a magnetic state of the switching magnetic material 102 responsive to an electrical current through the coil 103), and a non-switching magnet 105 (also referred to as a permanent magnet) including a non-switching magnetic material (having relatively high coercivity). The DM circuit is switched by changing the state (i.e., polarity) of the switching magnetic material 102 such that magnetic energy is either trapped inside the unit in a de-magnetized state (also referred to as a neutral or off state) as shown in FIG. 1A or pushed out through the poles 107 to clamp a component in a magnetized state (also referred to as an on state) as shown in FIG. 1B. By providing a reversed state as shown in FIG. 1C, an unbalanced electro-permanent magnet may facilitate demagnetization of some workpieces before removal in the off state of FIG. 1A.

While not shown in cross section in FIGS. 1A, 1B, and 1C, an electro-permanent magnetic device may include a two-dimensional array of switching magnets 101 (including switching magnetic material 102 and coil 103), non-switching magnets 105 (including non-switching magnetic material), and pole pieces 107. Moreover, the coils 103 of the switching magnets 101 may be electrically coupled in series or in parallel, with a controller providing electrical current through the coils 103 to switch the switching magnets 101 to provide the on, reversed, and off states. In the DM circuit of FIGS. 1A, 1B, and 1C, the switching magnets 101 are switched fully on in a first (forward) polarity to add to magnetic force of non-switching magnets 105 (e.g., as shown in the magnetized on state of FIG. 1B), the switching magnets 101 are switched fully on in a second (reversed) polarity to cancel the magnetic force of non-switching magnets 105 and also provide a slight reverse magnetized state (e.g., as shown in the reversed state of FIG. 1C), and the switching magnets 101 are switched partially on in the second polarity to provide a substantially neutral off state (e.g., as shown in the de-magnetized off state of FIG. 1A).

Devices using switching magnets are discussed, by way of example, in U.S. Pat. No. 7,999,645, in U.S. Pat. No. 6,292,078, in U.S. Pat. No. 4,847,582, in U.S. Pat. No. 4,507,635, and in U.S. Publication No. 2014/0285930, the disclosures of which are hereby incorporated herein in their entireties by reference.

Figure 2B:
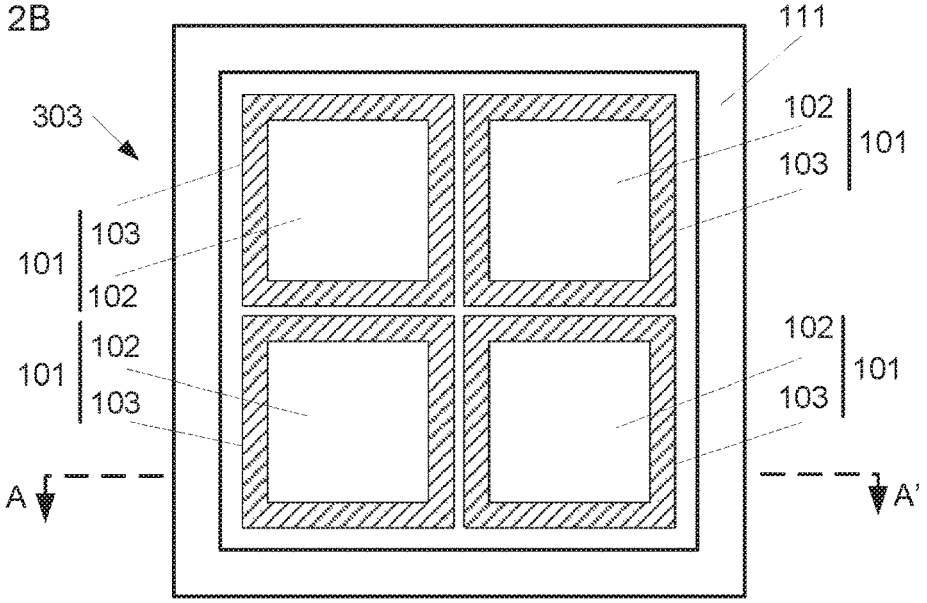
FIGS. 2B and 2C are plan views of the double magnet circuit of FIG. 2A taken at different levels B-B' and C-C', respectively, according to some embodiments of inventive concepts.
Figure 2C:
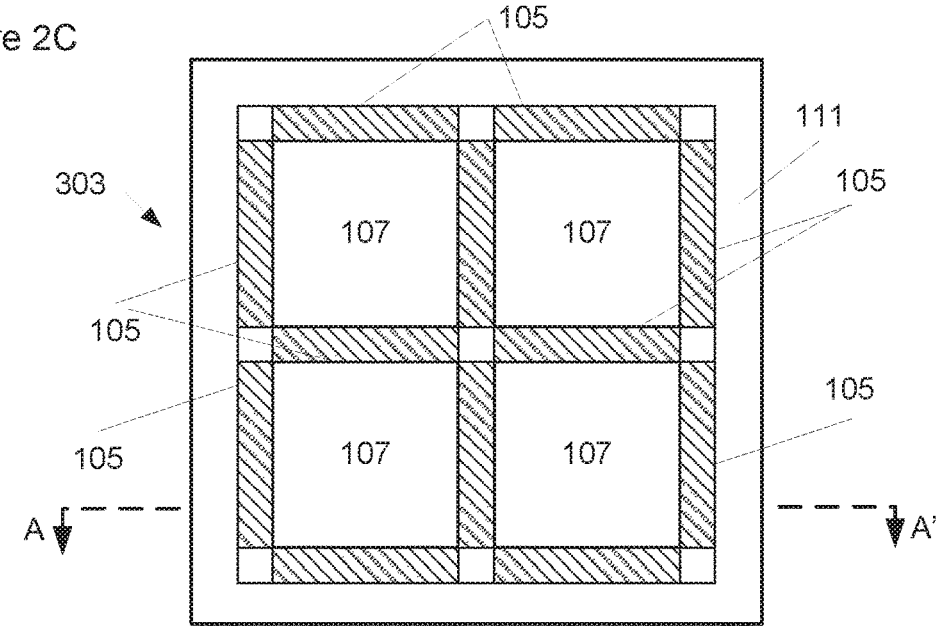

FIG. 2A is a cross sectional view illustrating a double magnet circuit according to some embodiments of inventive concepts, and FIGS. 2B and 2C are plan views of the double magnet circuit of FIG. 2A taken at different levels B-B' and C-C', respectively. As discussed above with respect to FIGS. 1A, 1B, and 1C, the double magnet circuit may include an array of: switching magnets 101, each of which includes switching magnetic material 102 (having relatively low coercivity) and a respective coil 103; non-switching magnets 105, each of which includes non-switching magnetic material (having relatively high coercivity); and pole pieces 107. While FIGS. 2A-C show a 2×2 array of switching magnets and pole pieces by way of example, arrays of any size may be provided according to embodiments of inventive concepts. As further shown in FIGS. 2A and 2C, the switching and non-switching magnets may be provided in housing 111, and a sealing material 109 (e.g., epoxy) may be provided between pole pieces 107.

Figure 3:
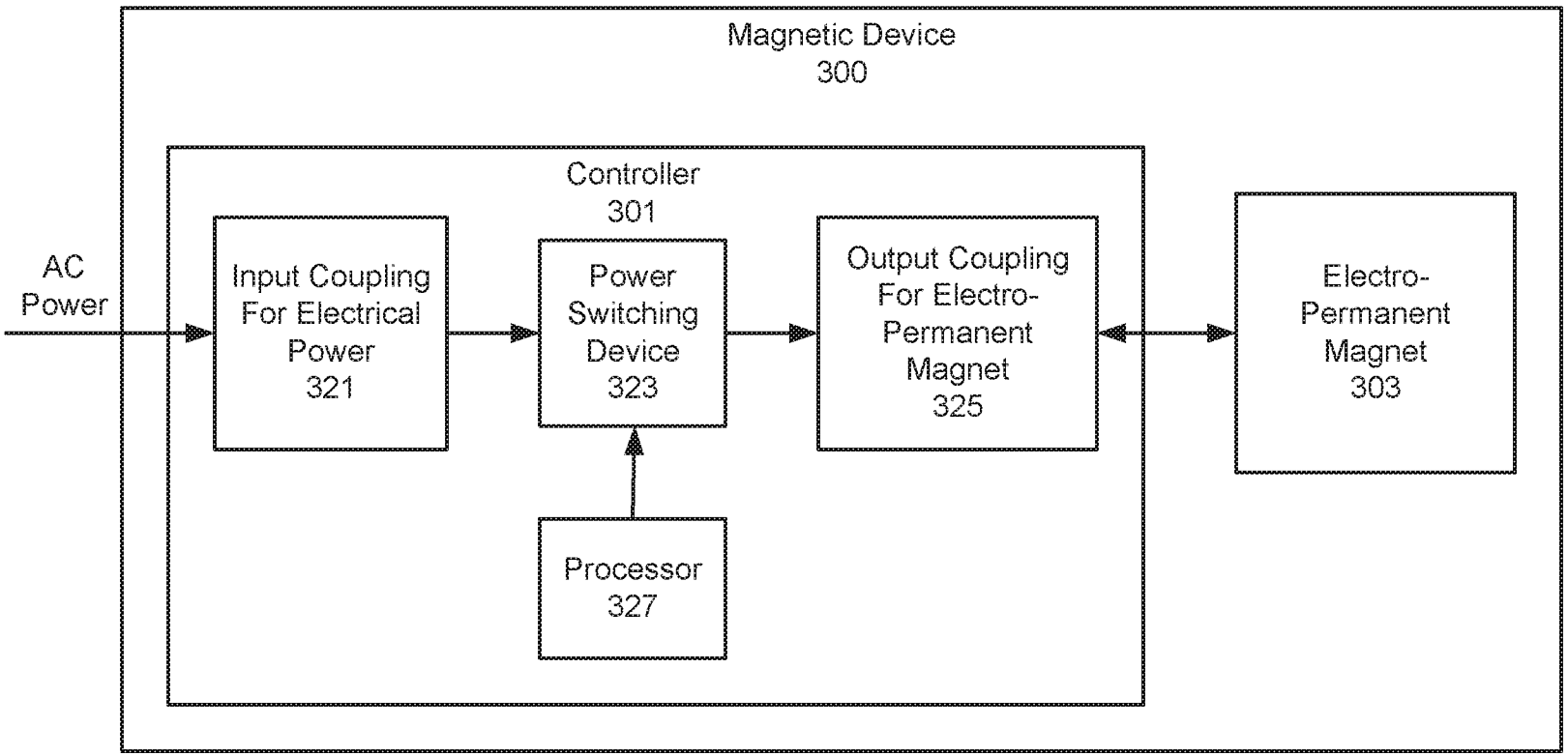
FIG. 3 is a block diagram illustrating a magnetic device including a controller and an electro-permanent magnet according to some embodiments of inventive concepts.

FIG. 3 is a block diagram illustrating a magnetic device 300 including electro-permanent magnet 303 as discussed above with respect to FIGS. 2A, 2B, and 2C coupled with controller 301. As shown, controller 301 may include power switching device 323 to control coupling of power between input coupling 321 for electrical power (e.g., from an AC power source) and output coupling 325 for electrical power (e.g., to electro-permanent magnet 325). In addition, controller 301 may include processor 327 configured to control operations of power switching device 323. Examples of controllers, processors, input couplings, and output couplings are discussed by way of example in U.S. Publication No. 2014/0285930, the disclosure of which is hereby incorporated herein in its entirety by reference.

Figure 5:
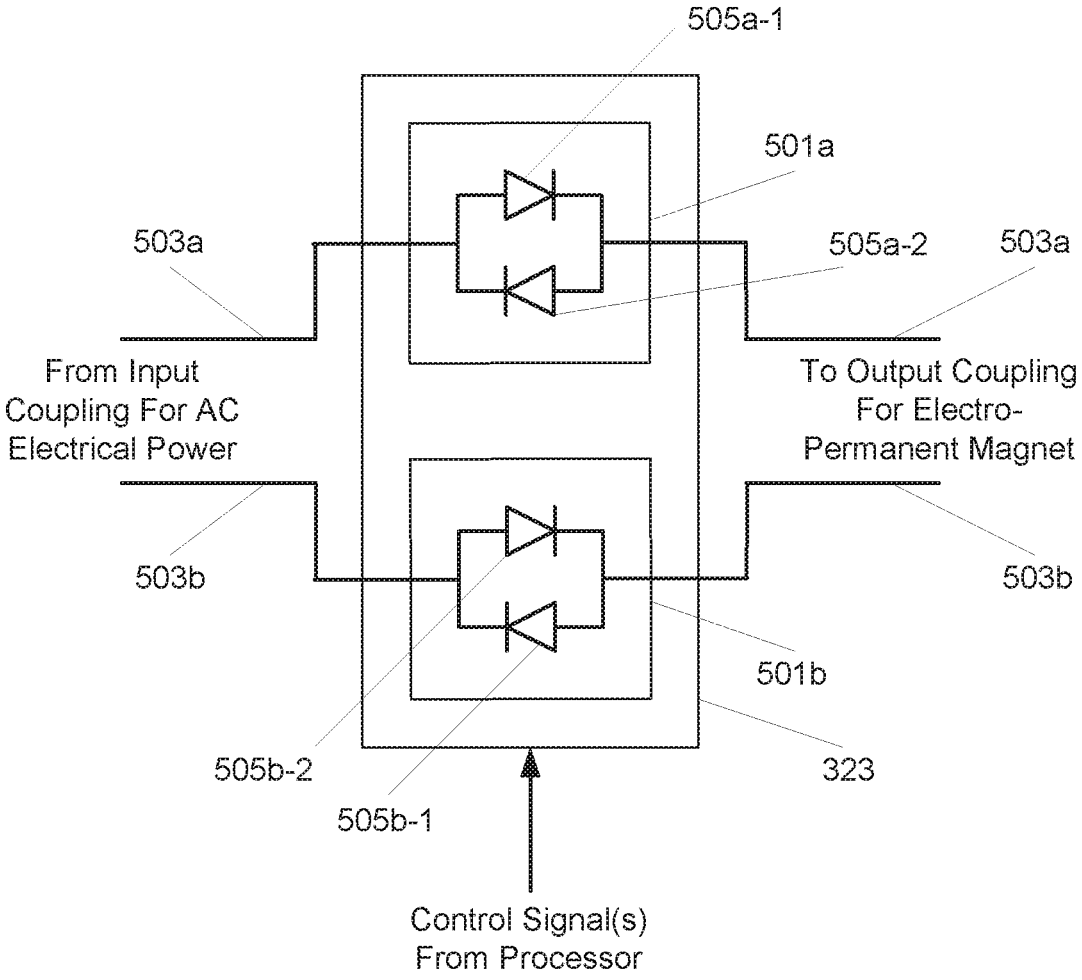
FIG. 5 is a schematic diagram illustrating a power switching device of FIG. 3 according to some embodiments of inventive concepts.

Power switching device 323, for example, may include first and second silicon controlled rectifier (SCR) bridges 501*a* and 501*b* on respective first and second power lines 503*a* and 503*b* as shown in FIG. 5. SCR bridge 501*a* may include silicon controlled rectifiers (SCRs) 505*a*-1 and 505*a*-2 under control of processor 327, and SCR bridge 501*b* may include SCRs 505*b*-1 and 505*b*-2 under control of processor 327. Processor 327 may thus fire SCRs 505*a*-1 and 505*b*-1 synchronously to provide controlled pulses of a first polarity (e.g., positive polarity) to electro-permanent magnet 303 (e.g., to turn electro-permanent magnet 303 on), and processor 327 may thus fire SCRs 505*a*-2 and 505*b*-2 synchronously to provide controlled pulses of a second polarity (e.g., negative polarity) to electro-permanent magnet 303 (e.g., to turn electro-permanent magnet 303 off). While two SCR bridges are shown by way of example, a single SCR bridge (either SCR bridge 501*a* on power line 503*a* or SCR bridge 501*b* on power line 503*b*) may be used according to some embodiments of inventive concepts.

Processor 327 can thus control power switching device 301 to provide controlled pulses of a first polarity to coils 103 of switching magnets 101 of electro-permanent magnet 303 to program switching magnets 101 to a first magnetic polarity so that magnetic fields of switching magnets 101 and permanent magnets add to generate a magnetic field extending beyond the working surface of electro-permanent magnet 303 to turn electro-permanent magnet 303 on as discussed above with respect to FIG. 1B. Processor 327 can also control power switching device 301 to provide controlled pulses of a second polarity to coils 103 of switching magnets 101 of electro-permanent magnet 303 to program switching magnets 101 to a fully on second magnetic polarity to provide the reversed state of FIG. 1C. Processor 327 can further control power switching device 301 to provide controlled pulses of the first polarity to coils 103 of switching magnets 101 to program switching magnets 101 to a partially on second magnetic polarity so that magnetic fields of switching magnets 101 and permanent magnets cancel beyond the working surface to turn electro-permanent magnet 303 off as discussed above with respect to FIG. 1A.

Electro-permanent magnets intended for high holding power may thus use Double Magnet DM circuits with a switching magnets 101 (each including a programmable semi-soft magnet material 102 surrounded by a coil 103) typically under respective magnetic pole pieces 107 and permanent (or non-programmable) magnets 105 (each including a hard magnet material) typically around sides of pole pieces 107, as shown in FIGS. 1A-C and 2A-C. In this way, it may be possible to pack sufficient magnetic material under and around each pole piece 107 (which may be steel) to fill an exposed working face of a mild steel pole piece 107 with sufficient magnetic flux to reach magnetic saturation (i.e., maximum flux density) to provide increased/maximum holding power.

To activate the circuit, the soft magnetic material of each switching/programmable magnet 101 may be magnetized using its respective coil 103 (e.g., applying electrical pulses of a first polarity from controller 301) to work with the hard, static, magnetic material of the non-switching/permanent magnets 105 around the pole piece 107 to fill the working face with magnetic flux.

To deactivate the circuit, the soft magnetic material of each switching/programmable magnet 101 may be reverse magnetized using its respective coil 103 (e.g., applying electrical pulses of a second polarity from controller 301) to capture the flux from the hard magnetic material within the structure.

To provide that the system is "OFF", the two sets of magnets (i.e., the permanent magnets 105 and the switching/programmable magnets 101) may provide balanced magnetic fields in the off state to provide that working surface 115 of each pole piece 107 is as nearly free of magnetic flux as possible/practical.

Without using the reversed state of FIG. 1C, a workpiece may not be de-magnetized if the electro-permanent magnet is turned directly from the on state to the off state so that the residually magnetized workpiece may be difficult to remove even though the electro-permanent magnet is "off". With a magnetic circuit including balanced programmable and non-programmable magnets which each generate a hypothetical maximum magnetic flux of 1, for example, when the circuit is turned on, magnetic flux of the semi-soft switching magnet of value 1 (forward polarity) may combine with magnetic flux of the hard permanent magnets of value 1, to provide a combined magnetic flux of 1+1=2=ON. When the circuit is turned off, magnetic flux of the semi-soft switching magnet now has a value of −1 (reversed polarity) that combines with magnetic flux of the hard permanent magnets of value +1, (−1)+(+1)=0=NEUTRAL (OFF). To hold ferromagnetic materials that do not retain magnetism (i.e., low residual materials), this system may work well. When the circuit goes to neutral magnetic flux, the workpiece may go to neutral magnetic flux, and with no magnetism flowing, the magnet may release the workpiece. For ferromagnetic materials that do retain magnetism (i.e., high residual materials), however, the result may be that the magnetic circuit goes neutral but that the workpiece remains partly magnetized and the residual magnetism in the workpiece creates/maintains a weak residual magnetic circuit.

Creation of this residual magnetic circuit may be resisted in some cases due to the balanced sets of hard/semi-soft magnetic materials covering sides and bases of the magnetic pole pieces being basically fully saturated in a close coupled magnetic loop. In high alloy, high hardness steels, however, this "weak" residual magnetic circuit may be quite tenacious, and it may be difficult to remove the workpiece.

Anything that creates a leakage path for magnetism between the pole pieces and that is in front of the hard/semi-soft magnets creating their close coupled magnetic loop may act as a conduit for the residual magnetism left in the workpiece. Stated in other words, a path may be provided to complete a residual magnetic circuit with the residual magnetism from the workpiece, and this residual magnetic circuit may dramatically increase the difficulty of removing the workpiece. Examples of features that may enhance such a leakage path are tooling plates designed to mount between the magnet and the workpiece to lift the part, locate the part, provide tool clearance beside the part, or to provide a full-metal working plate to enhance durability and sealing.

Examples of materials with high residual characteristics may include steels with high alloy content and/or high hardness, such as tool steels and bearing steels, particularly in a hardened state.

Anything that can be introduced between the workpiece and the magnetic system that increases magnetic reluctance may improve release. For example, an "air-gap" may be provided by introducing: non-magnetic layers such as paper; rough non-magnetic coating; shaped contacts such that the part only touches in very small area such that a small "air-gap" is maintained; etc. However, the "air-gap" solutions may be impractical, particularly when trying to maintain high accuracy or the ability to "re-qualify" the working surface in situ.

A Single Magnet (SM) circuit using a semi-soft magnetic material only (i.e., magnetized=ON, de-magnetized=OFF) may be an alternative magnetic circuit used for electro-permanent magnetic systems. By omitting the hard magnetic material, a full de-magnetizing sequence may be needed to switch the system OFF, and since the workpiece is also part of the magnetic circuit, the workpiece may also be demagnetized. An SM circuit can work well with excellent part demagnetization and release possible. A magnetic energy density of semi-soft magnet materials, however, may be dramatically lower than for modern hard magnetic materials (e.g., an order of magnitude lower) making it impractical to pack semi-soft magnets and control coils between the magnetic poles since an axial length of a soft magnet that may be needed could increase the pole spacing dramatically.

With semi-soft magnetic material placed only under the magnet poles, magnetic flux density that can be achieved on the working face of the poles may thus be approximately half of what can be achieved with the DM Double Magnet circuit. Since magnetic pull force is proportional to flux density squared, half the flux density equates to one quarter pull force. If pole area is halved, flux density can be returned to saturation levels at the expense of area. In tailored situations, pull force may be increased to one half of that achievable with a DM circuit. "Tailored" solutions, however, may not be universally applicable.

In summary, an electro-permanent magnet based on a DM magnetic circuit may have difficulty releasing high alloy steels, and an electro-permanent magnet based on an SM circuit may have difficulty achieving a desired holding power.

According to some embodiments of inventive concepts, electro-permanent magnet 303 of FIGS. 1A-C, 2A-C and 3 may be deliberately assembled in an unbalanced state such that when switching magnets 101 are fully on in a reversed polarity state, electro-permanent magnet 303 is slightly magnetized in a polarity that is opposite of a polarity of the ON state as discussed above with respect to FIG. 1C. In the ON state, switching magnets 101 are fully on in a forward polarity state so that magnetic fields of permanent magnets 105 and switching magnets 101 combine to generate a strong magnetic field of the forward polarity as discussed above with respect to FIG. 1B. When the switching magnets 101 are fully on in the reverse polarity state, the magnetic fields of permanent magnets 105 and switching magnets 101 largely cancel, but due to the imbalance, slight magnetic field of the reverse polarity extends beyond the working face.

An OFF sequence may thus involve a full reversal of the semi-soft magnet material 102 (using negative electrical pulses from controller 301 through coils 103) of the switching magnets 101 (providing the slight magnetic field of the reverse polarity) followed by a partial positive electrical pulse (using a positive electrical pulse/pulses from controller 301 through coils 103) to reduce the magnitude of the reverse polarity magnetic field of the switching magnets 101 to bring the system back to a neutral or off state as discussed above with respect to FIG. 1A.

The reversed state (when magnetic fields of switching magnets 101 are fully reversed) may be sufficiently negative to start to reverse magnetize a hard alloy steel workpiece with high residual characteristics. In this way, any residual magnetism in a steel workpiece can be knocked down to near zero to improve workpiece release when the system is returned to neutral.

To achieve a desired reverse imbalance in a given system, an amount of rare earth static magnetic material for permanent magnets 105 may be reduced relative to switching magnets 101, but this may reduce magnetic saturation in the on state thereby reducing holding power. To increase holding power in such a system, more flux may be provided from switching magnets 101 to balance out less flux from permanent magnets 105 to return the system to desired flux densities in the ON state. For example, a greater area of semi-soft switchable material of switching magnets 101 may be used and/or higher grade semi-soft switchable magnet material of switching magnets 101 (higher Br) may be used.

Some DM circuit designs may use AlNiCo 5 grade material as the soft material of switching magnets 101 because it is possible to pack enough under a pole piece with allowance for coil and desired gap between poles to improve/optimize the magnetic circuit for saturation. AlNiCo 5 switching magnets may be significantly less expensive than higher Br performing grades. Assuming there is no more area available to pack AlNiCo 5, a higher grade AlNiCo (such as 5DG or 5-7) may be used to provide greater magnetic flux from switching magnets 101.

For example, AlNiCo 5 may have a Br of 12.5 kG while AlNiCo 5-7 may have a nominal Br of 13.5 kG (e.g., an 8% increase). In a given electro-permanent magnet system, using a soft magnetic material with a relative Br increase of 8% together with a rare earth static magnet area for permanent magnets 105 that is reduced by 8% may provide a positive flux density, a full saturation, and a holding strength in the ON state that are equivalent to a flux density of the system before modification. The modified system, however, may provide a negative flux density in the fully reversed state having a magnitude that is about 8% of the positive flux density of the ON state.

AlNiCo 5DG has a nominal Br of 13.0 kG and Arcomax can achieve Br of 14.0 (at a high cost). Accordingly, Arcomax can generate a 12% negative swing while maintaining full saturation and holding power in the ON state (at a relatively high cost). The actual degree of negative swing can be increased by further reducing the area of hard magnet material of permanent magnets 105 which may result in a commensurate reduction in ON state saturation and holding power.

Design considerations may involve choosing desired polarity swing for improved release balanced against a least reduction in ON state saturation and holding power. In circuits where area for more AlNiCo is not available, switching from AlNiCo 5 to 5-7 may be a cost effective choice. A secondary benefit of using AlNiCo 5-7 grade material may include that it also has higher magnetic field strength to provide increased magnetic energy and better performance through an "air gap" (e.g., rough contact zones) for magnetically hard workpieces.

For systems where area for more semi-soft magnet material is available, increasing area for switching magnets 101 may be a more cost effective choice.

While a magnitude of a negative polarity swing is a matter of balancing costs and benefits, observation indicates that a desired swing may be less than 20%.

A complication may arise in achieving a true NEUTRAL state for the OFF condition when permanent magnets 105 and switching magnets 101 are unbalanced as discussed above.

A performance of coils 103 used to actuate the soft switchable magnet material of switching magnets 101 may vary depending on the presence of a ferromagnetic workpiece. In an "open circuit" condition without a workpiece present on a working surface of the electro-permanent magnet 303, a lower energization state for the soft magnet may result when compared to an energization state in "closed circuit" condition with a workpiece present on the working surface. In multi-pole chucks where the workpiece covers only some of the poles, an area where the part was located may remain magnetically "sticky" after the workpiece is removed.

A practical solution may be to balance the OFF state without a workpiece present. More particularly, when turning electro-permanent magnet 303 off to remove a workpiece, fire OFF (to a first OFF state), remove the workpiece, and then fire OFF a second time (to a second OFF state).

This change in balance point may also occur when top tooling (e.g., pole extensions) is used.

When using a grid plate or full-metal top plate, an intermediate plate between the magnetic circuit and the working face may provide a small leakage path between poles. This effect may be controlled, release may be improved and small balance imperfections may be reduced so that system performance may be improved without using a double-fire OFF.

It should be noted some applications for these systems may include systems for workpiece materials that have relatively high residual magnetism retention and relatively low magnetic saturation levels. In such systems, some sacrifice of full saturation in the on state may only affect holding power for these materials once it falls below their saturation capability (i.e., some reduction of the ON state saturation level can be achieved without affecting holding power for high residual steels).

According to some embodiments of inventive concepts, a DM double magnet system may be constructed with a deliberate and negative imbalance when in the full reversed polarity state which is returned to a "NEUTRAL" state with a tuned partial "ON" control pulse.

Saturation in the ON state may be improved/optimized by either: using higher Br grade semi-soft switching magnet material; or using more area of standard Br grade semi-soft switching magnet material (to counteract the intentionally lower saturation levels of static hard/permanent magnets that create the negative imbalance state).

The negative pulse may be sufficiently strong to begin to reverse magnetize high residual high alloy hard steels thus dramatically reducing the residual magnetism in these steels once released.

A second "OFF" sequence may be used after the part has been removed to return to a "NEUTRAL" state.

A "full metal face" may be used to neutralize a tendency of the "leakage path" created by the full metal face to cause increased release problems in the "OFF" or "NEUTRAL" state.

Using higher performance semi-soft magnet material for switching magnets 101 may provide a circuit of higher magnetic energy than a similar balanced circuit.

In a balanced electro-permanent magnet, a 4×4 two-dimensional array of poles (with each pole having a 50 mm×50 mm square surface) using AlNiCo 5 for the switching magnets and using neodymium hard magnets for the permanent magnets, magnetic fields of the switching magnets and the permanent magnets may essential cancel each other when the switching magnets are in a fully reversed state. According to some embodiments of inventive concepts, this electro-permanent magnet structure may be modified to provide an unbalanced structure using AlNiCo 5-7 to replace AlNiCo 5 for switching magnets 101 and to reduce the neodymium hard magnets for permanent magnets 105 by 18%.

A saturation level for the unbalanced structure may be approximately 18.5 kG in the on state, compared with a saturation level for the balanced structure of approximately 19.5 kG in the on state. A saturation level for the unbalanced structure may thus be 95% of the saturation level for the balanced structure, and a holding power for the unbalanced structure may be 90% of the holding power for the balanced structure. A performance of the unbalanced structure for alloy steels in a soft state and for harder/higher alloyed materials may be nearly 100% relative to the balanced structure.

The 16 pole balanced electro-permanent magnet discussed above may provide a magnetic energy of approximately 5.6 kG at a distance of 1.5 mm from the working surface and a magnetic energy of approximately 12.6 kG at 0.6 mm. The 16 pole unbalanced electro-permanent magnet discussed above with a bare working surface may provide a magnetic energy of approximately 6.7 kG at 1.5 mm from the bare working surface and a magnetic energy of approximately 13.2 kG at 0.6 mm from the bare working surface. The 16 pole unbalanced electro-permanent magnet discussed above with a grid plate may provide a magnetic energy of approximately 5.9 kG at 1.5 mm from the grid plate and a magnetic energy of approximately 10.3 kG at 0.6 mm from the grid plate.

According to some embodiments, increased energy and/or holding power may be provided using a higher grade of AlNiCo for switching magnets of an unbalanced electro-permanent magnet. For workpieces of materials having high residual magnetism, residual magnetism in the workpiece may be reduced when releasing the workpiece by providing a negative magnetic bias before returning to a neutral/off magnetic condition. With the unbalanced electro-permanent magnet, the switching magnets may be programmed to a fully reversed state to provide the negative magnetic bias, and a positive programming pulse may be used to return the electro-permanent magnet to the neutral/off magnetic condition. By transitioning a high residual workpiece to a negative magnetization condition, residual magnetism in the workpiece may be reduced, and release of the workpiece may be facilitated. Once the workpiece has been removed, the switching magnets may be transitioned through a second off cycle to return the electro-permanent magnet to the neutral state.

According to some embodiments of inventive concepts, electro-permanent magnet 303 may include a plurality of pole pieces 107, a plurality of permanent magnets 105, and a plurality of switching magnets 101. Each permanent magnet 105 may be arranged adjacent at least one of pole pieces 107, and each switching magnet 101 may be adjacent at least one of pole pieces 107. Each switching magnet 101 may include a soft magnetic material 102 and an electrically conductive coil 103 so that a polarity and a magnitude of a magnetic field generated by the soft magnetic material 102 is programmable responsive to electrical energy applied to the electrically conductive coil 103.

The plurality of switching magnets 101 may be unbalanced relative to the plurality of permanent magnets 105. More particularly, the plurality of switching magnets 101 may be unbalanced relative to the plurality of permanent magnets 105 so that magnetic fields of the switching and permanent magnets 101 and 105 combine to generate a first magnetic field having a first polarity and a first magnitude extending beyond a working surface in an on state (e.g., as shown in FIG. 1B), and so that magnetic fields of the switching and permanent magnets 101 and 105 combine to generate a second magnetic field having a second polarity and a second magnitude extending beyond the working surface in a reversed state with the second magnitude being less than the first magnitude. The plurality of switching magnets 101 may be further programmable so that magnetic fields of the switching and permanent magnets 101 and 105 combine to generate a third magnetic field having a third magnitude extending beyond the working surface in an off/neutral state with the third magnitude being less than the second magnitude (e.g., in a neutral condition as shown in FIG. 1A). For example, each of switching magnets 101 may be fully magnetized in opposite directions in the on and reversed states.

Each of pole pieces 107 may be between a respective one of switching magnets 101 and working face 115.

A magnetic flux generated by switching magnets 101 in a fully magnetized state may be greater than a magnetic flux generated by permanent magnets 105. For example, a magnetic flux generated by one switching magnet 101 in a fully magnetized state adjacent a respective pole piece 107 may be greater than a combined magnet flux of all permanent magnets adjacent that pole piece. According to some embodiments, a magnetic flux generated by the plurality of switching magnets 101 in a fully magnetized state may be 3 percent to 50 percent greater than a magnetic flux generated by the plurality of permanent magnets 105. Each of permanent magnets 105 may be a rare earth permanent magnet. Soft material 102 of each switching magnet 101 may include AlNiCo and/or FeCrCo.

Controller 301 may be provided for electro-permanent magnet 303 as shown in FIG. 3. As discussed above, electro-permanent magnet 303 may include permanent magnets 105, switching magnets 101, and working surface 115. Controller 301 may include power switching device 323 between an input coupling 321 for an electrical power source and output coupling 325 for electro-permanent magnet 303. In addition, processor 327 may be coupled to power switching device 323. More particularly, processor 327 may be configured to control power switching device 323 to switch electro-permanent magnet 303 to an on state such that magnetic fields of switching and permanent magnets 101 and 105 combine to generate a first magnetic field having a first magnitude and a first polarity extending beyond working surface 115 (e.g., as shown in FIG. 1B). In the on state, a workpiece may thus be magnetically secured to working surface 115 even after removing electrical power. For example, output coupling 325 may be detached from electro-permanent magnet 303 and the first magnetic field may be maintained.

When removal of the workpiece is desired, output coupling 325 can be attached to electro-permanent magnet (if previously detached), and processor 327 may then be configured to switch electro-permanent magnet 303 to a reversed state having a second polarity such that magnetic fields of switching and permanent magnets 101 and 105 combine to generate a second magnetic field having a second magnitude and a second polarity extending beyond the working surface, with the second magnitude being less than the first magnitude and wherein the first and second polarities are different. As discussed above, the second magnetic field of the reversed state may reduce residual magnetism in the workpiece to allow easier removal. Moreover, the second magnitude may be no more than 33 percent of the first magnitude, and the second magnitude may be at least 3 percent of the first magnitude Processor 327 may be configured to then switch electro-permanent magnet 303 to a first off state (after switching electro-permanent magnet 303 to the reversed state) such that magnetic fields of switching and permanent magnets 101 and 105 combine to generate a third magnetic field having a magnitude beyond working surface 115 that is no more than 50 percent of the second magnitude beyond working surface 115. For example, the third magnetic field may be substantially neutral beyond the working surface in the first off state. In the first off state, the workpiece may be removed from working surface 115. Magnetisms of permanent magnets 105 may thus be unbalanced relative to magnetisms of switching magnets 101 in the reversed state, and magnetisms of permanent magnets 105 may be substantially balanced relative to magnetisms of switching magnets 101 in the first off state.

After removing the workpiece, processor 327 may be configured to switch electro-permanent magnet 303 to a second off state such that magnetic fields of switching and permanent magnets 101 and 105 combine to generate a fourth magnetic field having a magnitude that is no more than one quarter of the second magnitude beyond working surface 115 without the workpiece adjacent to working surface 115.

Figure 4:
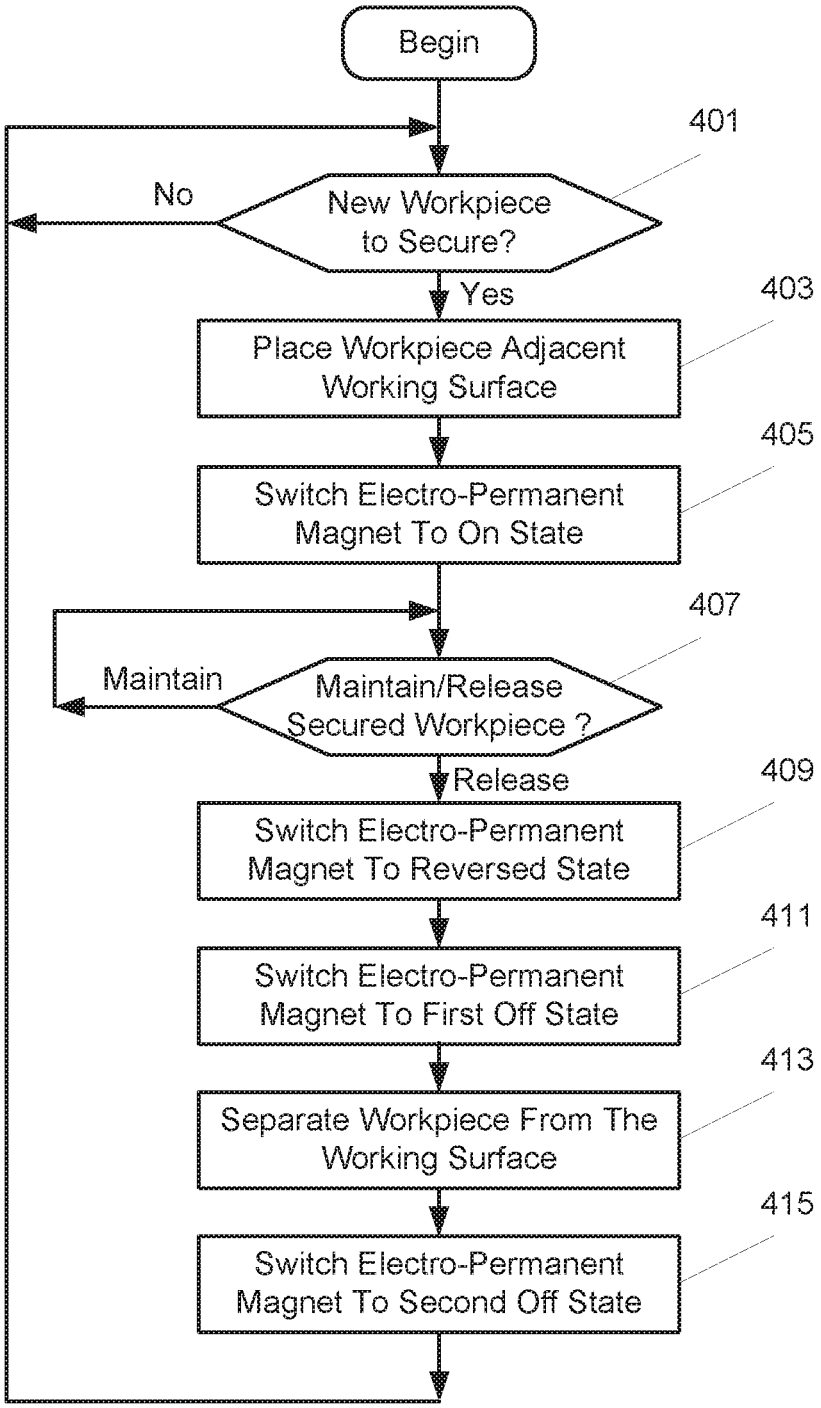
FIG. 4 is a flow chart illustrating operations of the electro-permanent magnet of FIG. 3 according to some embodiments of inventive concepts.

According to some embodiments of inventive concepts, methods of operating electro-permanent magnet 303 are discussed with respect to the flow chart of FIG. 4. In an initial state, electro-permanent magnet 303 may be in a neutral state so that magnetic fields of switching and permanent magnets 101 and 105 substantially cancel each other. In this state, a workpiece may be placed adjacent to working surface 115 without magnetic coupling. When a workpiece is to be secured adjacent to working surface 115 at block 401, controller 301 may proceed with operations of FIG. 4.

Before switching electro-permanent magnet 303 to the on state, a workpiece may be placed adjacent to working surface 115 at block 403. At block 405, controller 300 may switch electro-permanent magnet 303 to the on state such that magnetic fields of switching and permanent magnets 101 and 105 combine to generate the first magnetic field having the first magnitude and the first polarity extending beyond working surface 115 as discussed above so that the workpiece is magnetically secured to working surface 115 in the on state.

After switching electro-permanent magnet 303 to the on state at block 405, the workpiece may remain magnetically secured to working surface 115 indefinitely at block 407 without power. In fact, output coupling 325 (and thus controller 301) may be detached from electro-permanent magnet 303 without affecting the on state magnetic field.

Once the workpiece is to be released from working surface 115 at block 407, controller 301 may proceed with operations to release the workpiece. For example, output coupling 325 may be attached to electro-permanent magnet 303, and user input may be used to initiate release. Moreover, because controller 301 may be detached/attached from/to electro-permanent magnet 303, one controller can be used with electro-permanent magnet 303 for operation 405, and a different controller can be used with the same electro-permanent magnet for operations 409, 411, 413, and 415.

At block 409, controller 301 may switch electro-permanent magnet 303 to the reversed state having the second polarity such that magnetic fields of switching and permanent magnets 101 and 105 combine to generate the second magnetic field having the second magnitude and the second polarity extending beyond working surface 115. As discussed above, the second magnitude may be less than the first magnitude, and the first and second polarities may be different. For example, the second magnitude may be no more than 33 percent of the first magnitude, and the second magnitude may be at least 3 percent of the first magnitude.

At block 411, controller 301 may switch electro-permanent magnet 303 to a first off state such that magnetic fields of switching and permanent magnets 101 and 105 combine to generate the third magnetic field having the magnitude beyond working surface 115 that is no more than 50 percent of the second magnitude beyond working surface 115. More particularly, the first off state is provided with the workpiece adjacent to the working surface, and the third magnetic field may be substantially neutral beyond working surface 115 in the off state with the workpiece thereon. Processor 327 may control power switching device 323 to apply one or more electrical pulses of a same polarity or different polarities to coils 103 of switching magnets 101 to bring electro-permanent magnet 303 to the neutral condition (also referred to as an off or zero condition) with the workpiece adjacent the working surface 115. Processor 327 may use a control loop(s) including feedback (based on field measurement feedback) to more accurately achieve the desired neutral condition.

After switching electro-permanent magnet 303 to the first off state at block 411, the workpiece may be separated (i.e., removed) from working surface 115 at block 413. After separating the workpiece from working surface 115 at block 413, controller 301 may switch electro-permanent magnet 303 to a second off state at block 415 such that magnetic fields of switching and permanent magnets 101 and 105 combine to generate a fourth magnetic field having a magnitude that is no more than one quarter of the second magnitude beyond the working surface without the workpiece adjacent to working surface 115. Processor 327 may control power switching device 323 to apply one or more electrical pulses of a same polarity or different polarities to coils 103 of switching magnets 101 to bring electro-permanent magnet 303 to the neutral condition (also referred to as an off or zero condition) without the workpiece adjacent the working surface 115. Processor 327 may use a control loop(s) including feedback (based on field measurement feedback) to more accurately achieve the desired neutral condition.

As shown in FIGS. 1A, 1B, and 1C, the plurality of switching magnets 101 may include a first switching magnet (on the left) and a second switching magnet (on the right). Electro-permanent magnet 303 may also include first pole piece 107 (on the left) and second pole piece 107 (on the right), with the first pole piece between the first switching magnet and working surface 115 and with the second pole piece between the second switching magnet and the working surface 115. At least one of permanent magnets 105 is arranged between the first and second pole pieces with a north pole of the permanent magnet adjacent the first pole piece and a south pole of the permanent magnet adjacent the second pole piece.

Switching electro-permanent magnet 303 to the on state at block 405 may include switching the first switching magnet to provide a north pole adjacent the first pole piece and switching the second switching magnet to provide a south pole adjacent the second pole piece so that the first pole piece acts as a north pole and the second pole piece acts as a south pole as shown in FIG. 1B. For example, switching electro-permanent magnet 303 to the on state may include switching the first switching magnet to a fully magnetized state with the north pole adjacent the first pole piece and switching the second switching magnet to a fully magnetized state with the south pole adjacent the second pole piece.

Switching electro-permanent magnet 303 to the reversed state at block 409 may include switching the first switching magnet to provide a south pole adjacent the first pole piece and switching the second switching magnet to provide a north pole adjacent the second pole piece so that the first pole piece acts as a south pole and the second pole piece acts as a north pole as shown in FIG. 1C. For example, switching electro-permanent magnet 303 to the reversed state may include switching the first switching magnet to a fully magnetized state with the south pole adjacent the first pole piece and switching the second switching magnet to the fully magnetized state with the north pole adjacent the second pole piece.

Switching electro-permanent magnet 303 to the first off state at block 413 may include reducing magnetism of the first and second switching magnets while maintaining polarities of the first and second switching magnets from the reversed state as shown in FIG. 1A. For example, switching electro-permanent magnet 303 to the off state may include reducing magnetism of the first and second switching magnets to a partially magnetized state while maintaining polarities of the first and second switching magnets from the reversed state.

As discussed above, each of switching magnets 101 may include soft magnetic material 102 and electrically conductive coil 103 surrounding soft magnetic material 102. Switching electro-permanent magnet 303 to the on state at block 405 may include applying first electrical energy (having a first polarity) to electrically conductive coils 103 of switching magnets 101 to fully magnetize each of the plurality of switching magnets 101 in a first state (having a first magnetic polarity). Processor 327 may control power switching device 323 to deliver a plurality of pulses having a first polarity (e.g., positive polarity) to electrically conductive coils 103 to switch switching magnets 101 to the on state as shown in FIG. 1B. As shown in FIG. 1B, in the first state, half of switching magnets 101 are magnetized with north poles oriented toward working surface 115 and half of switching magnets 101 are magnetized with south poles oriented toward working surface 115.

Switching electro-permanent magnet 303 to the reversed state at block 409 may include applying second electrical energy to electrically conductive coils 03 of switching magnets 101 to fully magnetize the plurality of switching magnets in a second state (having a second magnetic polarity) opposite the first state. Processor 327 may control power switching device 323 to deliver a plurality of pulses having a second polarity (e.g., negative polarity) to electrically conductive coils 103 to switch switching magnets 101 to the reversed state as shown in FIG. 1C. As shown in FIG. 1C, in the second state, half of switching magnets 101 are magnetized with south poles oriented toward working surface 115 and half of switching magnets 101 are magnetized with north poles oriented toward working surface 115.

Switching electro-permanent magnet 303 to the off state at block 411 may include applying third electrical energy to the electrically conductive coils of the switching magnets to partially magnetize the plurality of switching magnets in the second state (having the second magnetic polarity). Processor 327 may control power switching device 323 to deliver one or more pulses having first polarity (e.g., positive polarity) to electrically conductive coils 103 to switch switching magnets 101 to the off state as shown in FIG. 1A. As shown in FIG. 1A, in the third state, half of switching magnets 101 are magnetized with south poles oriented toward working surface 115 and half of switching magnets 101 are magnetized with north poles oriented toward working surface 115 as shown in FIG. 1A. Magnetization polarities of switching magnets 101 are the same in the reversed and off states of FIGS. 1C and 1A, but a magnitude of magnetism of switching magnets 101 in the reversed state is greater than a magnitude of magnetism of switching magnets 101 in the off state. Accordingly, magnetisms of the plurality of permanent magnets 105 are unbalanced relative to magnetisms of the plurality of switching magnets 101 in the reversed state of FIG. 1C, and magnetisms of the plurality of permanent magnets 105 are substantially balanced relative to magnetisms of the plurality of switching magnets 101 in the off state.

Figure 6A:
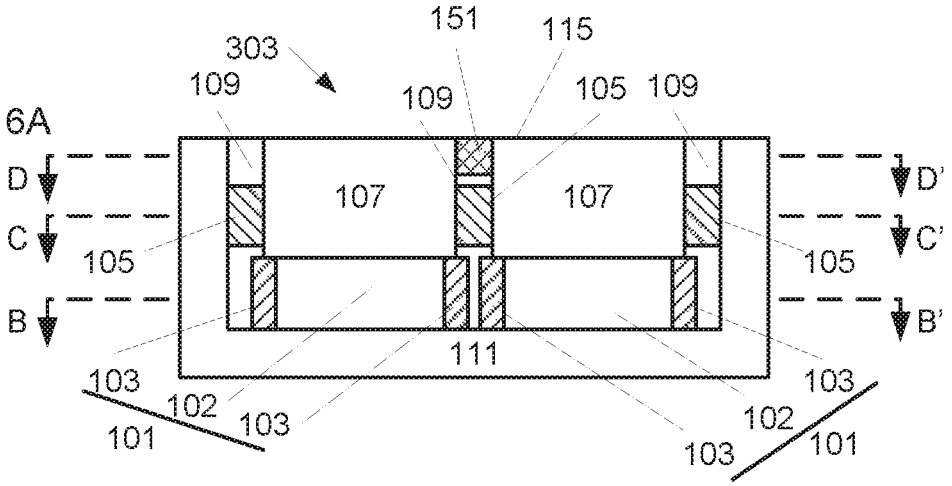
FIGS. 6A and 6B are cross sectional and plan views illustrating a double magnet circuit according to some embodiments of inventive concepts.
Figure 6B:
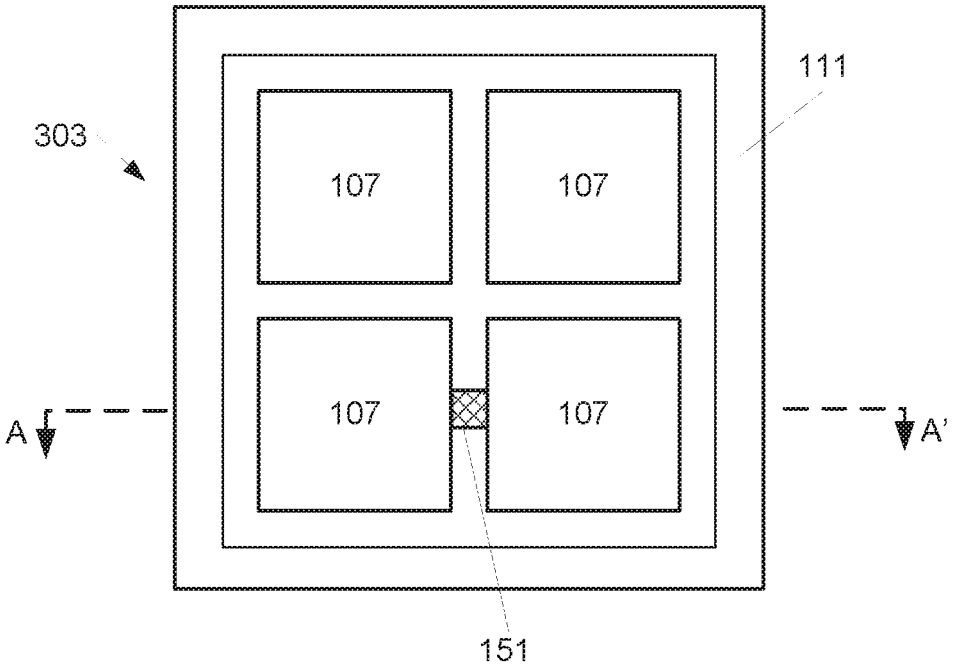

FIGS. 6A and 6B are cross sectional and plan views illustrating a double magnet circuit according to some additional embodiments of inventive concepts. The structure of FIGS. 6A and 6B is the same as that of FIGS. 2A, 2B, and 2C with the addition of magnetic field sensor 151 (e.g., a Hall effect sensor) between two of the pole pieces. The plan views of FIGS. 2B and 2C are not repeated with respect to FIG. 6A, because the portions of FIG. 6A illustrated by these plan views are unchanged. The magnetic field sensor 151 may be coupled with processor 327 through output coupling 325 of FIG. 3. More particularly, a cable from electro-permanent magnet 303 may provide a detachable coupling with output coupling 325, and the cable and the output coupling 325 may provide electrical coupling between power switching device 323 and coils of electro-permanent magnet 303 and between processor 327 and magnetic field sensor 151. Field measurement feedback from magnetic field sensor 151 can thus be used by processor 327 to more accurately achieve desired neutral conditions of operations 411 and 415. Magnetic field sensor 151 may thus be used to determine when a magnetic field between adjacent pole pieces is sufficiently low to complete operations of blocks 411 and/or 415. For a neutral condition, there should be very low and/or no magnetic field detected by sensor 151 between the adjacent pole pieces, and feedback from sensor 151 can be used by processor 327 to determine when to stop applying electrical pulses used to bring electro-permanent magnet 303 to the neutral condition.

In the above-description of various embodiments of present inventive concepts, it is to be understood that the terminology used herein is for the purpose of describing particular embodiments only and is not intended to be limiting of inventive concepts. Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

When an element is referred to as being "connected", "coupled", "responsive", or variants thereof to another element, it can be directly connected, coupled, or responsive to the other element or intervening elements may be present. In contrast, when an element is referred to as being "directly connected", "directly coupled", "directly responsive", or variants thereof to another element, there are no intervening elements present. Like numbers refer to like elements throughout. Furthermore, "coupled", "connected", "responsive", or variants thereof as used herein may include wirelessly coupled, connected, or responsive. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Example embodiments are described herein with reference to block diagrams and/or flowchart illustrations of computer-implemented methods, apparatus (systems and/or devices) and/or computer program products. It is understood that a block of the block diagrams and/or flowchart illustrations, and combinations of blocks in the block diagrams and/or flowchart illustrations, can be implemented by computer program instructions that are performed by one or more computer circuits. These computer program instructions may be provided to a processor circuit (also referred to as a processor) of a general purpose computer circuit, special purpose computer circuit, and/or other programmable data processing circuit to produce a machine, such that the instructions, which execute via the processor of the computer and/or other programmable data processing apparatus, transform and control transistors, values stored in memory locations, and other hardware components within such circuitry to implement the functions/acts specified in the block diagrams and/or flowchart block or blocks, and thereby create means (functionality) and/or structure for implementing the functions/acts specified in the block diagrams and/or flowchart block(s). Processor functionality discussed herein, for example, may thus be performed using one or more computer circuits implemented using one or more microprocessors, logic elements, memory elements, circuit boards, logic cards, etc.

These computer program instructions may also be stored in a tangible computer-readable medium that can direct a computer or other programmable data processing apparatus to function in a particular manner, such that the instructions stored in the computer-readable medium produce an article of manufacture including instructions which implement the functions/acts specified in the block diagrams and/or flowchart block or blocks.

A tangible, non-transitory computer-readable medium may include an electronic, magnetic, optical, electromagnetic, or semiconductor data storage system, apparatus, or device. More specific examples of the computer-readable medium would include the following: a portable computer diskette, a random access memory (RAM) circuit, a read-only memory (ROM) circuit, an erasable programmable read-only memory (EPROM or Flash memory) circuit, a portable compact disc read-only memory (CD-ROM), and a portable digital video disc read-only memory (DVD/BlueRay).

The computer program instructions may also be loaded onto a computer and/or other programmable data processing apparatus to cause a series of operational steps to be performed on the computer and/or other programmable apparatus to produce a computer-implemented process such that the instructions which execute on the computer or other programmable apparatus provide steps for implementing the functions/acts specified in the block diagrams and/or flowchart block or blocks. Accordingly, embodiments of inventive concepts may be embodied in hardware and/or in software (including firmware, resident software, microcode, etc.) that runs on a processor such as a digital signal processor, which may collectively be referred to as "circuitry," "a module" or variants thereof.

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated. Finally, other blocks may be added/inserted between the blocks that are illustrated, and/or blocks/operations may be omitted without departing from the scope of inventive concepts. Moreover, although some of the diagrams include arrows on communication paths to show a primary direction of communication, it is to be understood that communication may occur in the opposite direction to the depicted arrows.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of various example combinations and subcombinations of embodiments and of the manner and process of making and using them, and shall support claims to any such combination or subcombination.

Many variations and modifications can be made to the embodiments without substantially departing from the principles of present inventive concepts. All such variations and modifications are intended to be included herein within the scope of present inventive concepts. Accordingly, the above disclosed subject matter is to be considered illustrative, and not restrictive, and the appended claims are intended to cover all such modifications, enhancements, and other embodiments, which fall within the spirit and scope of present inventive concepts.

That which is claimed is:

1. A method of operating an electro-permanent magnet including a plurality of permanent magnets, a plurality of switching magnets, and a working surface, the method comprising:

providing the electro-permanent magnet in an on state such that magnetic fields of the switching and permanent magnets combine to generate a first magnetic field having a first magnitude and a first polarity extending beyond the working surface, wherein providing the electro-permanent magnet in the on state includes providing a workpiece that is magnetically secured to the working surface in the on state;

switching the electro-permanent magnet from the on state to a reversed state having a second polarity such that magnetic fields of the switching and permanent magnets combine to generate a second magnetic field having a second magnitude and a second polarity extending beyond the working surface, wherein the second magnitude is less than the first magnitude, and wherein the first and second polarities are different; and after switching the electro-permanent magnet to the reversed state, switching the electro-permanent magnet from the reversed state to a first off state with the workpiece adjacent to the working surface such that magnetic fields of the switching and permanent magnets combine to generate a third magnetic field having a magnitude beyond the working surface that is no more than 50 percent of the second magnitude beyond the working surface;

after switching the electro-permanent magnet to the first off state, separating the workpiece from the working surface; and after separating the workpiece from the working surface, switching the electro-permanent magnet to a second off state such that magnetic fields of the switching and permanent magnets combine to generate a fourth magnetic field having a magnitude that is no more than one quarter of the second magnitude beyond the working surface without the workpiece adjacent to the working surface.

2. The method of claim 1 wherein the third magnetic field is substantially neutral beyond the working surface in the off state.

3. The method of claim 1 wherein the plurality of switching magnets includes first and second switching magnets, wherein the electro-permanent magnet further includes first and second pole pieces, wherein the first pole piece is between the first switching magnet and the working surface, wherein the second pole piece is between the second switching magnet and the working surface, and wherein at least one of the permanent magnets is arranged between the first and second pole pieces with a north pole of the permanent magnet adjacent the first pole piece and a south pole of the permanent magnet adjacent the second pole piece.

4. The method of claim 3 wherein switching the electro-permanent magnet to the on state comprises switching the first switching magnet to provide a north pole adjacent the first pole piece and switching the second switching magnet to provide a south pole adjacent the second pole piece so that the first pole piece acts as a north pole and the second pole piece acts as a south pole, wherein switching the electro-permanent magnet to the reversed state comprises switching the first switching magnet to provide a south pole adjacent the first pole piece and switching the second switching magnet to provide a north pole adjacent the second pole piece so that the first pole piece acts as a south pole and the second pole piece acts as a north pole, and wherein switching the electro-permanent magnet to the off state comprises reducing magnetism of the first and second switching magnets while maintaining polarities of the first and second switching magnets from the reversed state.

5. The method of claim 1 wherein the second magnitude is no more than 33 percent of the first magnitude, and wherein the second magnitude is at least 3 percent of the first magnitude.

6. The method of claim 1 wherein magnetisms of the plurality of permanent magnets are unbalanced relative to magnetisms of the plurality of switching magnets in the reversed state, and wherein magnetisms of the plurality of permanent magnets are substantially balanced relative to magnetisms of the plurality of switching magnets in the off state.

7. The method of claim 1 wherein each of the switching magnets includes a soft magnetic material and an electrically conductive coil surrounding the soft magnetic material, wherein switching the electro-permanent magnet to the on state comprises applying first electrical energy to the electrically conductive coils of the switching magnets to fully magnetize the plurality of switching magnets in a first state, wherein switching the electro-permanent magnet to the reversed state comprises applying second electrical energy to the electrically conductive coils of the switching magnets to fully magnetize the plurality of switching magnets in a second state opposite the first state, and wherein switching the electro-permanent magnet to the off state comprises applying third electrical energy to the electrically conductive coils of the switching magnets to partially magnetize the plurality of switching magnets in the second state.

8. The method of claim 1 wherein switching the electro-permanent magnet to the off state comprises switching the electro-permanent magnet from the reversed state to the off state responsive to magnetic field measurement feedback.

9. The method of claim 1 wherein the third magnetic field is substantially neutral beyond the working surface in the off state.

10. The method of claim 1 wherein providing the electro-permanent magnet in the on state including providing a workpiece that is magnetically secured to the working surface in the on state, and wherein the off state is a first off state with the workpiece adjacent to the working surface, the method further comprising:

after switching the electro-permanent magnet to the first off state, separating the workpiece from the working surface; and after separating the workpiece from the working surface, switching the electro-permanent magnet to a second off state such that magnetic fields of the switching and permanent magnets combine to generate a fourth magnetic field having a magnitude that is no more than one quarter of the second magnitude beyond the working surface without the workpiece adjacent to the working surface.

11. A method of operating an electro-permanent magnet including a plurality of permanent magnets, a plurality of switching magnets, a working surface, a first pole piece, and a second pole piece, wherein the plurality of switching magnets includes first and second switching magnets, wherein the first pole piece is between the first switching magnet and the working surface, wherein the second pole piece is between the second switching magnet and the working surface, and wherein at least one of the permanent magnets is arranged between the first and second pole pieces with a north pole of the permanent magnet adjacent the first pole piece and a south pole of the permanent magnet adjacent the second pole piece, the method comprising:

providing the electro-permanent magnet in an on state such that magnetic fields of the switching and permanent magnets combine to generate a first magnetic field having a first magnitude and a first polarity extending beyond the working surface, wherein providing the electro-permanent magnet in the on state comprises switching the first switching magnet to provide a north pole adjacent the first pole piece and switching the second switching magnet to provide a south pole adjacent the second pole piece so that the first pole piece acts as a north pole and the second pole piece acts as a south pole;

switching the electro-permanent magnet from the on state to a reversed state having a second polarity such that magnetic fields of the switching and permanent magnets combine to generate a second magnetic field having a second magnitude and a second polarity extending beyond the working surface, wherein the second magnitude is less than the first magnitude, and wherein the first and second polarities are different, wherein switching the electro-permanent magnet to the reversed state comprises switching the first switching magnet to provide a south pole adjacent the first pole piece and switching the second switching magnet to provide a north pole adjacent the second pole piece so that the first pole piece acts as a south pole and the second pole piece acts as a north pole; and after switching the electro-permanent magnet to the reversed state, switching the electro-permanent magnet from the reversed state to an off state such that magnetic fields of the switching and permanent magnets combine to generate a third magnetic field having a magnitude beyond the working surface that is no more than 50 percent of the second magnitude beyond the working surface, wherein switching the electro-permanent magnet to the off state comprises reducing magnetism of the first and second switching magnets while maintaining polarities of the first and second switching magnets from the reversed state.

12. The method of claim 11 wherein switching the electro-permanent magnet to the on state comprises switching the first switching magnet to a fully magnetized state with the north pole adjacent the first pole piece and switching the second switching magnet to a fully magnetized state with the south pole adjacent the second pole piece, wherein switching the electro-permanent magnet to the reversed state comprises switching the first switching magnet to a fully magnetized state with the south pole adjacent the first pole piece and switching the second switching magnet to the fully magnetized state with the north pole adjacent the second pole piece, and wherein switching the electro-permanent magnet to the off state comprises reducing magnetism of the first and second switching magnets to a partially magnetized state while maintaining polarities of the first and second switching magnets from the reversed state.

13. The method of claim 11 wherein the second magnitude is no more than 33 percent of the first magnitude, and wherein the second magnitude is at least 3 percent of the first magnitude.

14. The method of claim 11 wherein magnetisms of the plurality of permanent magnets are unbalanced relative to magnetisms of the plurality of switching magnets in the reversed state, and wherein magnetisms of the plurality of permanent magnets are substantially balanced relative to magnetisms of the plurality of switching magnets in the off state.

15. The method of claim 11 wherein each of the switching magnets includes a soft magnetic material and an electrically conductive coil surrounding the soft magnetic material, wherein switching the electro-permanent magnet to the on state comprises applying first electrical energy to the electrically conductive coils of the switching magnets to fully magnetize the plurality of switching magnets in a first state, wherein switching the electro-permanent magnet to the reversed state comprises applying second electrical energy to the electrically conductive coils of the switching magnets to fully magnetize the plurality of switching magnets in a second state opposite the first state, and wherein switching the electro-permanent magnet to the off state comprises applying third electrical energy to the electrically conductive coils of the switching magnets to partially magnetize the plurality of switching magnets in the second state.

16. The method of claim 11 wherein switching the electro-permanent magnet to the off state comprises switching the electro-permanent magnet from the reversed state to the off state responsive to magnetic field measurement feedback.

17. The method of claim 11 wherein switching the electro-permanent magnet to the on state comprises switching the first switching magnet to a fully magnetized state with the north pole adjacent the first pole piece and switching the second switching magnet to a fully magnetized state with the south pole adjacent the second pole piece, wherein switching the electro-permanent magnet to the reversed state comprises switching the first switching magnet to a fully magnetized state with the south pole adjacent the first pole piece and switching the second switching magnet to the fully magnetized state with the north pole adjacent the second pole piece, and wherein switching the electro-permanent magnet to the off state comprises reducing magnetism of the first and second switching magnets to a partially magnetized state while maintaining polarities of the first and second switching magnets from the reversed state.

18. A controller for an electro-permanent magnet including a plurality of permanent magnets, a plurality of switching magnets, a working surface, a first pole piece, and a second pole piece, wherein the plurality of switching magnets includes first and second switching magnets, wherein the first pole piece is between the first switching magnet and the working surface, wherein the second pole piece is between the second switching magnet and the working surface, and wherein at least one of the permanent magnets is arranged between the first and second pole pieces with a north pole of the permanent magnet adjacent the first pole piece and a south pole of the permanent magnet adjacent the second pole piece, the controller comprising:

a power switching device between an input coupling for an electrical power source and an output coupling for the electro-permanent magnet; and a processor coupled to the power switching device, where the processor is configured to control the power switching device to, provide the electro-permanent magnet in an on state such that magnetic fields of the switching and permanent magnets combine to generate a first magnetic field having a first magnitude and a first polarity extending beyond the working surface, wherein providing the electro-permanent magnet in the on state comprises switching the first switching magnet to provide a north pole adjacent the first pole piece and switching the second switching magnet to provide a south pole adjacent the second pole piece so that the first pole piece acts as a north pole and the second pole piece acts as a south pole, switch the electro-permanent from the on state to a reversed state having a second polarity such that magnetic fields of the switching magnet and the permanent magnet combine to generate a second magnetic field having a second magnitude and a second polarity extending beyond the working surface wherein the second magnitude is less than the first magnitude and wherein the first and second polarities are different, wherein switching the electro-permanent magnet to the reversed state comprises switching the first switching magnet to provide a south pole adjacent the first pole piece and switching the second switching magnet to provide a north pole adjacent the second pole piece so that the first pole piece acts as a south pole and the second pole piece acts as a north pole, and switch the electro-permanent magnet from the reversed state to an off state such that magnetic fields of the switching and permanent magnets combine to generate a third magnetic field having a magnitude beyond the working surface that is no more than 50 percent of the second magnitude beyond the working surface, wherein switching the electro-permanent magnet to the off state comprises reducing magnetism of the first and second switching magnets while maintaining polarities of the first and second switching magnets from the reversed state.

19. The controller of claim 18 wherein the third magnetic field is substantially neutral beyond the working surface in the off state.

20. The controller of claim 18 wherein the off state is a first off state, wherein the processor is configured to switch the electro-permanent magnet to the first off state with a workpiece adjacent to the working surface, and wherein the processor is further configured to switch the electro-permanent magnet to a second off state such that magnetic fields of the switching and permanent magnets combine to generate a fourth magnetic field having a magnitude that is no more than one quarter of the second magnitude beyond the working surface without the workpiece adjacent to the working surface.

21. The controller of claim 18 wherein the second magnitude is no more than 33 percent of the first magnitude, and wherein the second magnitude is at least 3 percent of the first magnitude.

22. The controller of claim 18 wherein magnetisms of the plurality of permanent magnets are unbalanced relative to magnetisms of the plurality of switching magnets in the reversed state, and wherein magnetisms of the plurality of permanent magnets are substantially balanced relative to magnetisms of the plurality of switching magnets in the off state.

23. The controller of claim 18 wherein the processor is configured to switch the electro-permanent magnet to the off state by switching the electro-permanent magnet from the reversed state to the off state responsive to magnetic field measurement feedback.

* * * * *